US008070250B2

(12) United States Patent
Dohki

(10) Patent No.: US 8,070,250 B2
(45) Date of Patent: Dec. 6, 2011

(54) IMAGE FORMING APPARATUS

(75) Inventor: Yohzoh Dohki, Nagoya (JP)

(73) Assignee: Ricoh Company, Ltd., Tokyo (JP)

( * ) Notice: Subject to any disclaimer, the term of this patent is extended or adjusted under 35 U.S.C. 154(b) by 472 days.

(21) Appl. No.: 12/272,349

(22) Filed: Nov. 17, 2008

(65) Prior Publication Data

US 2009/0127776 A1 May 21, 2009

(30) Foreign Application Priority Data

Nov. 15, 2007 (JP) ..... 2007-297010

(51) Int. Cl.
*B41J 2/01* (2006.01)
*B41J 29/38* (2006.01)

(52) U.S. Cl. ..... 347/16; 347/101; 347/104; 271/3.15; 271/258.01; 271/266

(58) Field of Classification Search ..... 347/16, 347/104; 271/3.14, 3.15, 3.18, 3.21, 258.01, 271/265.01, 266
See application file for complete search history.

(56) References Cited

U.S. PATENT DOCUMENTS

| | | | | |
|---|---|---|---|---|
| 7,418,235 | B2 | 8/2008 | Nonaka et al. | |
| 7,431,422 | B2 | 10/2008 | Asanuma et al. | |
| 7,434,928 | B2 | 10/2008 | Dohki | |
| 7,798,490 | B2 * | 9/2010 | Tamura et al. | 271/227 |
| 7,821,683 | B2 * | 10/2010 | Ito et al. | 358/496 |
| 7,871,068 | B2 * | 1/2011 | Yamazaki | 271/10.03 |
| 2003/0128253 | A1 * | 7/2003 | Kitahara et al. | 347/42 |
| 2005/0194730 | A1 | 9/2005 | Nishida et al. | |
| 2009/0122096 | A1 * | 5/2009 | Fujita | 347/16 |
| 2009/0230608 | A1 * | 9/2009 | Kimura et al. | 271/10.01 |

FOREIGN PATENT DOCUMENTS

| | | | |
|---|---|---|---|
| JP | 03-256945 | | 11/1991 |
| JP | 2000-310928 | A * | 11/2000 |
| JP | 2005-007799 | | 1/2005 |
| JP | 2005-43425 | A * | 5/2005 |
| JP | 2006-082231 | | 3/2006 |
| JP | 2006-084644 | A * | 3/2006 |
| JP | 2007-072366 | A * | 3/2007 |
| JP | 2007-175979 | | 7/2007 |
| JP | 2007-249098 | A * | 9/2007 |

OTHER PUBLICATIONS

English Translation of JP2005-43425-A.*
English Translation of JP2000-310928-A.*
English Translation of JP2007-72366-A.*
English Translation of JP2007-249098-A.*
English Translation of JP2006-84644-A.*

* cited by examiner

*Primary Examiner* — Julian Huffman
*Assistant Examiner* — Sharon A Polk
(74) *Attorney, Agent, or Firm* — Oblon, Spivak, McClelland, Maier & Neustadt, L.L.P.

(57) ABSTRACT

An image forming apparatus includes a recording head, a transport belt, a pressure device, a sheet detection device, an ejection/transport device, and a control device. The control device controls generating a first stop timing of the sheet transportation by the transport belt, at which first stop timing the transfer belt stops transporting the sheet, and that controls a predetermined delay time after which a second stop timing is generated, at which second stop timing the ejection/transport device stops transporting the sheet, and that shortens the delay time after the sheet detection device detects a trailing edge of the sheet.

19 Claims, 9 Drawing Sheets

IMAGE FORMING APPARATUS

CROSS-REFERENCE TO RELATED APPLICATIONS

This application is based upon and claims priority under 35 U.S.C. §119 to Japanese Patent Application No. 2007-297010, filed Nov. 15, 2007, the entire contents of which are hereby incorporated by reference.

BACKGROUND OF THE INVENTION

1. Field of the Invention

The present invention generally relates to an image forming apparatus including a recording head for ejecting recording liquid droplets.

2. Description of the Background Art

As for known image forming apparatuses, there are printers, facsimile machines, copiers, plotters, and multi-function machines. One example of such image forming apparatuses is a liquid jet recording apparatus (e.g., an inkjet recording apparatus). The liquid jet recording apparatus performs an image forming (also referred to as "recording", "printing", and the like) operation by using a recording head that ejects droplets of ink droplets onto a sheet. The liquid jet recording apparatus includes, for example, a serial type image forming apparatus that forms images by ejecting liquid droplets while moving the recording head in a main scanning direction, or a line type image forming apparatus that forms images by ejecting liquid droplets without moving the recording head.

It is to be noted that the term "image forming apparatus" includes apparatuses that form images by depositing ink to materials such as paper, string, fiber, fabric, leather, metal, plastic, glass, wood, ceramic, etc. Furthermore, the term "image formation" not only includes forming images that have a meaning (e.g., letters, shapes) on a medium, but also includes forming images having no particular meaning (e.g., patterns, liquid droplets arbitrarily deposited to a medium). Furthermore, the term "ink" not only includes so-called ink, but also includes any liquid that can be used to form images (e.g., recording liquid, fixing liquid). Furthermore, the term "sheet" not only includes papers, but also includes any materials onto which ink droplets can adhere (e.g., a sheet for an overhead projector, a fabric, a so-called recording medium or recording sheet, and the like).

As an example of such image forming apparatuses, Japanese Patent Registration No. 2897960 (Patent Document 1) discloses an image forming apparatus that transports a sheet adhering to a transport belt due to an electrostatic attraction force to ensure a flatness of the sheet and a high-accuracy in a distance between a recording head and the sheet because it is necessary to raise accuracy of a deposit position of liquid droplets on the sheet.

Japanese Patent Laid-Open Publication No. 2007-175979 (Patent Document 2) discloses an image forming apparatus including a sheet ejection/transport device so as to transport the sheet for ejection at a downstream side of a transport belt, which transports a sheet on which an image is formed, with respect to a sheet transport direction.

In a serial type image forming apparatus, sheets are intermittently transported by a transport belt. Therefore, it is better that a sheet ejection/transport device, which is disposed at a downstream side of the transport belt with respect to the sheet transport direction, is also driven intermittently in synchronization with the sheet transportation by the transport belt. In this case, if the intermittent transport amount by the sheet ejection/transport device is the same or less than the intermittent transport amount by the transport belt, the sheet transported from the transport belt may become bent, resulting in a sheet jam. Alternatively, the electrostatic attraction force may dissolve due to an uplifting of the transport belt or the sheet, resulting in a trouble in an image forming position. Consequently, it is set so that the intermittent transport amount by the sheet ejection/transport device is more than the intermittent transport amount by the transport belt to thereby maintain a tension on the sheet being transported and keep the sheet flat.

However, when the transport belt and the sheet ejection/transport device are driven with such a configuration, if the tension of the sheet by the sheet ejection/transport device is stronger than the holding force of the sheet (force for holding the sheet on the belt surface) by the transport belt, the sheet is not intermittently transported correctly against the recording head, resulting in an image degradation.

SUMMARY OF THE INVENTION

The present invention has been made in view of the above-mentioned and other circumstances.

It is an object of the present invention to at least partially address the drawbacks in the background technology.

An image forming apparatus according to one exemplary aspect of the present invention includes a recording head that ejects liquid droplets onto a sheet, a transport belt (opposing the recording head) that transports the sheet in a sheet feeding direction, a pressure device that presses the sheet against the transport belt at an upstream side of the recording head with respect to the sheet transport direction, a sheet detection device that detects the sheet at an upstream side of a nip of the pressure device and the transport belt with respect to the sheet transport direction, an ejection/transport device disposed at a downstream side of the sheet detection device with respect to the sheet transport direction, and that transports the sheet in a sheet ejection direction by driving in synchronization with the transport belt, and a control device that controls generating a first stop timing of the sheet transportation by the transport belt, at which first stop timing the transfer belt stops transporting the sheet, and that controls a predetermined delay time after which a second stop timing is generated, at which second stop timing the ejection/transport device stops transporting the sheet, and that shortens the delay time after the sheet detection device detects a trailing edge of the sheet.

In another exemplary aspect, an image forming apparatus includes a transport device (opposing a recording head) that transports the sheet and that includes a roller that nips the sheet, a pressure device that presses the sheet against the transport device at an upstream side of the roller with respect to the sheet transport direction, a sheet detection device that detects the sheet at an upstream side of the transport device with respect to the sheet transport direction, an ejection/transport device disposed at a downstream side of the sheet detection device with respect to the sheet transport direction, and that transports the sheet in a sheet ejection direction by driving in synchronization with the transport device, and a control device that controls generating a first stop timing of the sheet transportation by the transport belt, at which first stop timing the transfer belt stops transporting the sheet, and that controls a predetermined delay time after which a second stop timing is generated, at which second stop timing the ejection/transport device stops transporting the sheet, and that shortens the delay time after the sheet detection device detects a trailing edge of the sheet.

According to the above-described image forming apparatuses, it is possible to decrease a tension by the sheet ejection/ transport device when a sheet holding force onto a transport belt is only an attraction force of the transport belt. This makes it possible to maintain a sheet transport accuracy and to prevent a debasement of image quality.

BRIEF DESCRIPTION OF THE DRAWINGS

A more complete appreciation of the disclosure and many of the attendant advantages and features thereof can be readily obtained and understood from the following detailed description with reference to the accompanying drawings.

DETAILED DESCRIPTION OF EXEMPLARY EMBODIMENTS

Figure 1:
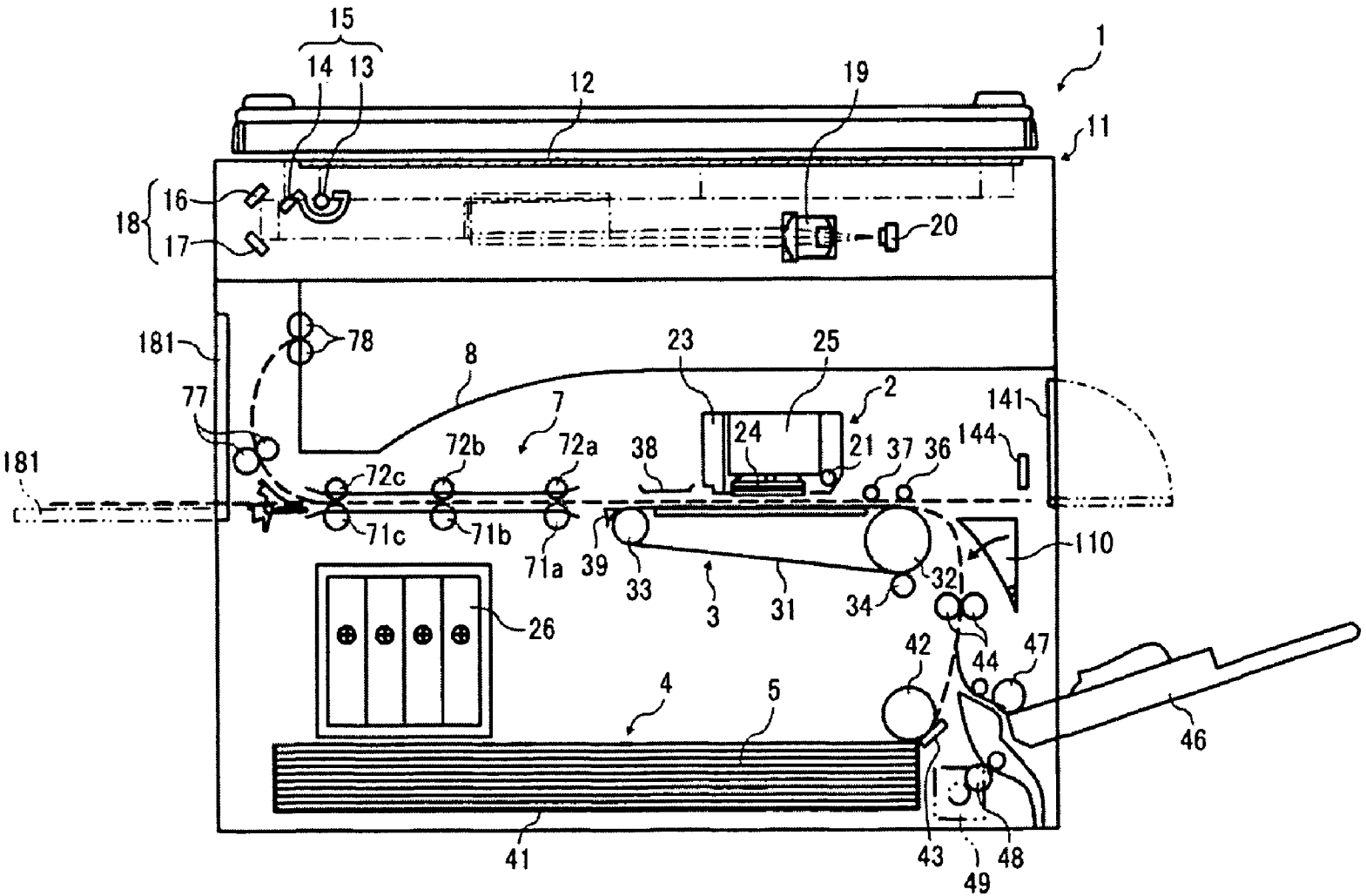
FIG. 1 is a schematic diagram illustrating a configuration of an image forming apparatus according to an embodiment of the present invention.
Figure 2:
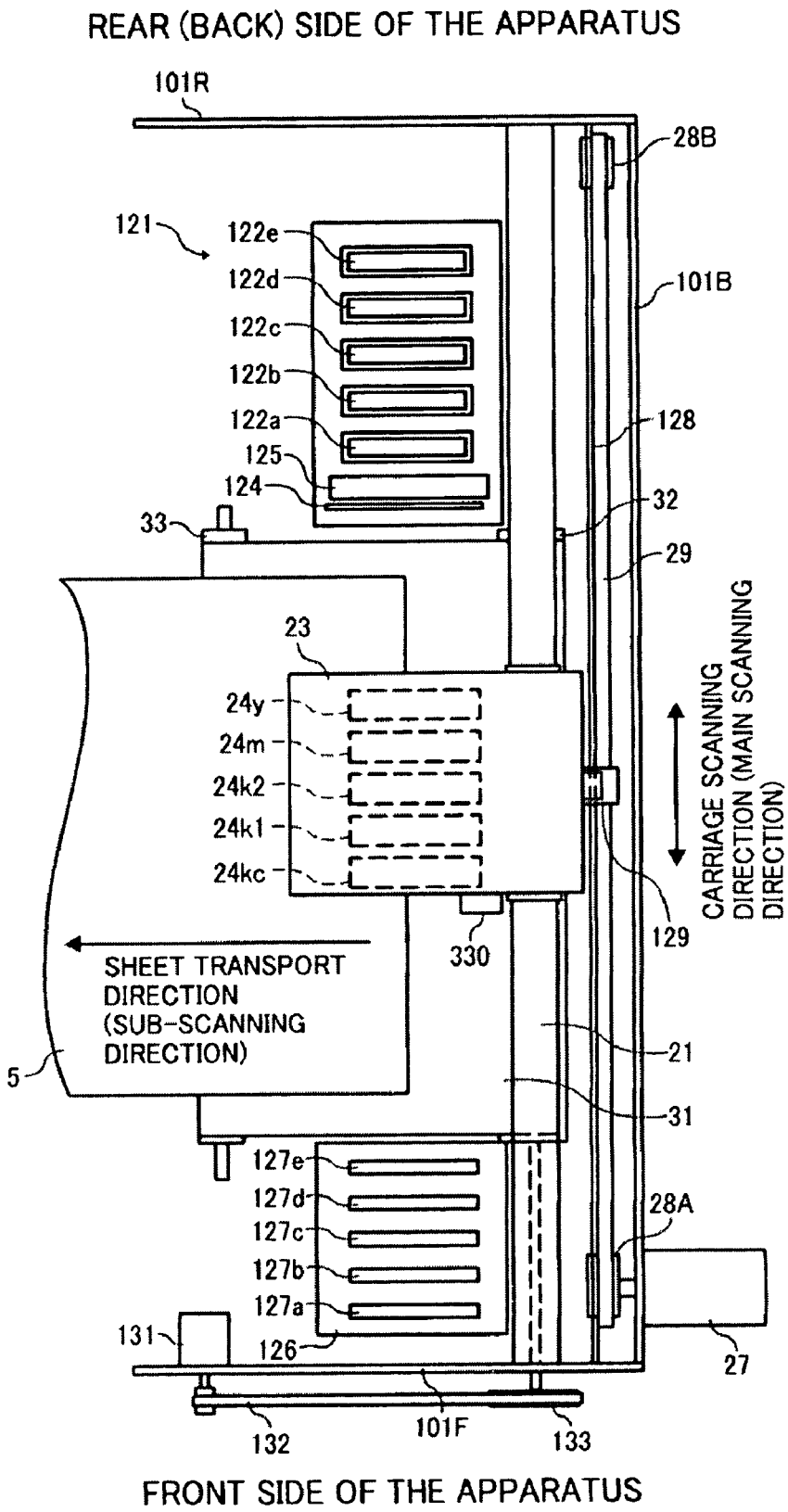
FIG. 2 is a plan view illustrating an image forming unit and a sub-scanning direction transport unit of the image forming apparatus of FIG. 1.
Figure 3:
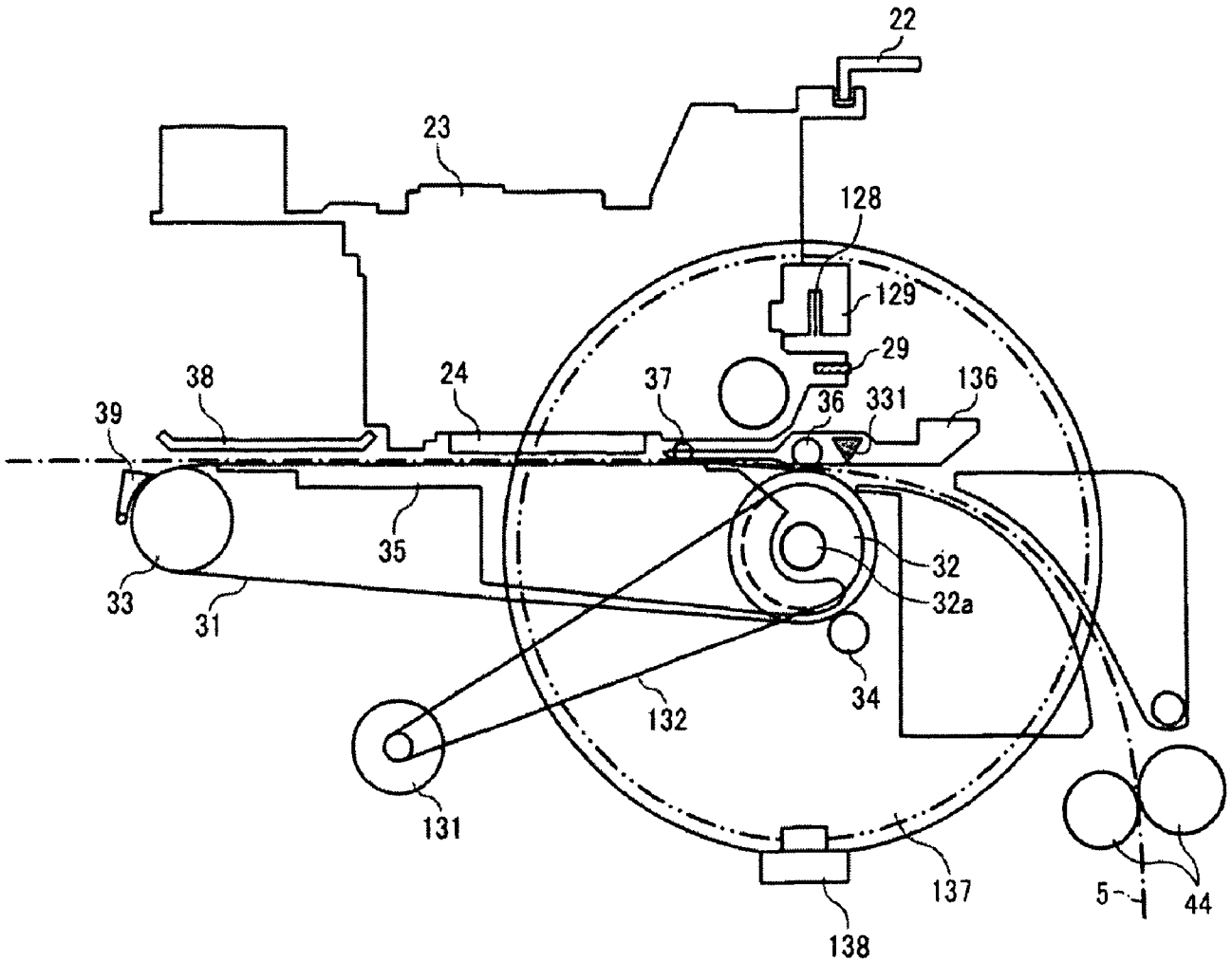
FIG. 3 is a cut-away front view illustrating the image forming apparatus of FIG. 1.
Figure 4:
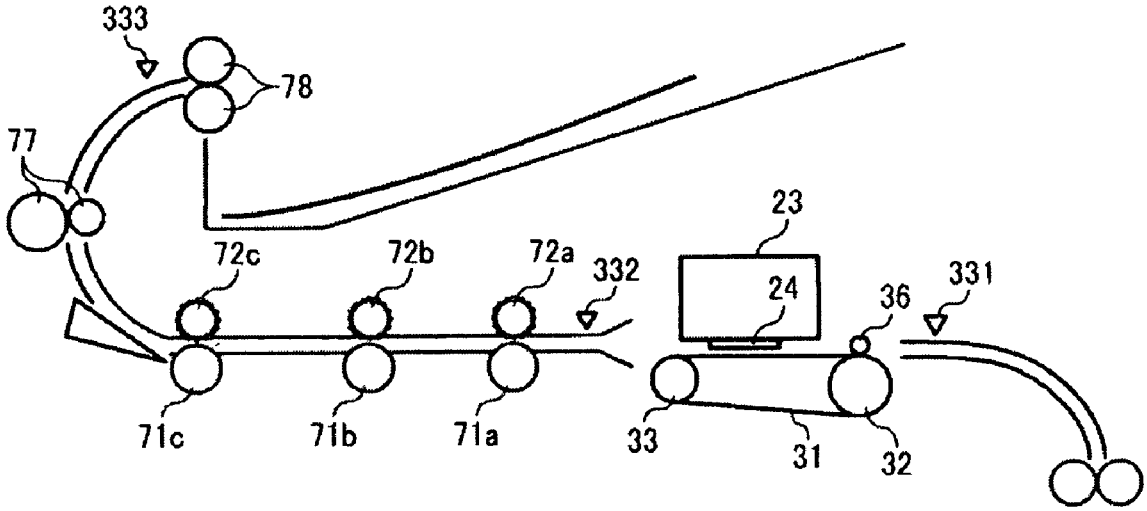
FIG. 4 is a diagram for explaining a sheet transport path of the image forming apparatus of FIG. 1.

Exemplary embodiments of the present invention are described hereinafter with reference to the accompanying drawings. An image forming apparatus of an embodiment of the present invention is described below with reference to FIGS. 1 through 4. FIG. 1 schematically illustrates a configuration of the image forming apparatus. FIG. 2 is a plan view illustrating an image forming unit 2 and a sub-scanning direction transport unit 3 of the image forming apparatus. FIG. 3 is a side view illustrating the image forming apparatus. FIG. 4 illustrates a sheet transport path.

The image forming apparatus includes, in an apparatus main body 1, the image forming unit 2 that forms an image on a sheet (recording medium) 5 and the sub-scanning direction transport unit 3 that transports the sheet 5. In the image forming apparatus, sheets 5 are fed one by one from a sheet feed unit 4 including a sheet cassette 41 disposed at the bottom of the apparatus main body 1. The sheet 5 is transported by the sub-scanning direction transport unit 3 to a position facing the image forming unit 2, at which an image is formed on the sheet 5 by liquid droplets ejected from the image forming unit 2. Then the sheet 5 is ejected by a sheet ejection/transport unit 7 onto a sheet ejection tray 8 disposed at the upper side of the apparatus main body 1.

The image forming apparatus further includes an image reading unit (for example a scanner unit) 11 disposed above the sheet ejection tray 8 in the apparatus main body 1 and configured to read images. The image reading unit 11 serves as an image data input unit for reading image data, based on which an image is formed by the image forming unit 2. In the image reading unit 11, an image of the original document placed on a contact glass 12 is scanned by moving a first scanning optical unit 15, including a light source 13 and a mirror 14, and a second scanning optical unit 18, including mirrors 16 and 17. The scanned image of the original document is read as image signals by an image reading element 20 disposed behind a lens 19. The read image signals are digitized and processed into print data to be printed out.

With reference to FIG. 2 also, in the image forming unit 2 of the image forming apparatus, a carriage 23 is movable in the main scanning direction and is held by a carriage guide 21, for example a guide rod, as a main guide member, extending between a front side panel 101F and a rear side panel 101R, and a guide stay 22 (FIG. 3) as a sub-guide member, disposed at the side of a rear stay 101B. The carriage 23 is moved in the main scanning direction by a main scanning motor 27 via a timing belt 29 extending around a drive pulley 28A and a driven pulley 28B.

On the carriage 23 are mounted a total of five recording heads (liquid ejection heads) 24, namely, recording heads 24*k*1 and 24*k*2 for ejecting black (K) ink, a recording head 24*c* for cyan (C) ink, a recording head 24*m* for magenta (M) ink, and a recording head 24*y* for yellow (Y) ink. These recording heads 24*k*1, 24K2, 24*c*, 24*m*, and 24*y* may be referred to as the recording heads 24 when the colors thereof are not specifically referenced. The image forming unit 2 is a shuttle type, which reciprocally moves the carriage 23 in the main scanning direction while ejecting liquid droplets from the recording heads 24 to form an image on the sheet 5 being transported in a sheet transport direction (the sub-scanning direction) by the sub-scanning direction transport unit 3.

On the carriage 23 are also mounted tanks 25 (FIG. 1) that supply color recording liquids to the corresponding recording heads 24. Referring back to FIG. 1, ink cartridges 26 respectively storing black (K) ink, cyan (C) ink, magenta (M) ink, and yellow (Y) ink are detachably attached to a cartridge attachment section from the front side of the apparatus main body 1. The inks in the ink cartridges 26 are supplied to the corresponding tanks 25. The black ink is supplied from the black ink cartridge 26 to two black tanks 25.

The recording head 24 may be a piezo type head that includes a pressure generating or actuator unit, which is used for applying pressure to ink in an ink passage or pressure generating chamber and is configured to deform a wall of the ink passage so as to change the volume of the ink passage, thereby ejecting ink droplets; a thermal type head configured to heat the ink in an ink passage using a heating element so as to form bubbles, thereby ejecting the ink with pressure of the bubbles; or an electrostatic type head that includes a diaphragm on a wall of an ink passage and an electrode opposing the diaphragm, and is configured to deform the diaphragm with static electricity between the diaphragm and the electrode so as to change the volume of the ink passage, thereby ejecting ink droplets.

A linear scale 128 (FIG. 2) is disposed that extends between the front side panel 101F and the rear side panel 101R in the main scanning direction of the carriage 23. The carriage 23 includes an encoder sensor 129 including, for example, a transmissive photo sensor for detecting slits of the linear scale 128. The linear scale 128 and the encoder sensor 129 constitute a linear encoder that detects movement of the carriage 23.

On one side of the carriage 23 is disposed a leading edge detection sensor 330 that detects a leading edge of the sheet 5.

More specifically, the leading edge detection sensor 330 detects the sheet 5 at a downstream side of a nip of an endless transport belt 31 and a pressure roller 36 with respect to the sheet transport direction.

A maintenance recovery mechanism 121 for maintaining and restoring the condition of nozzles of the recording head 24 is provided in a non-printing region at one side in the scanning direction of the carriage 23. The maintenance recovery mechanism 121 includes one suction cap 122*a*, serving also as a dry-proof cap, and four dry-proof caps 122*b* through 122*e* for capping nozzle faces of the five recording heads 24. The maintenance recovery mechanism 121 further includes a wiper blade 124 for wiping the nozzle faces of the recording heads 24, and an idle ejection receiver 125 for idle ejection. Another idle ejection receiver 126 for idle ejection is disposed in a non-printing region at the other end in the scanning direction of the carriage 23. The idle ejection receiver 126 includes openings 127*a* through 127*e*.

Referring also to FIGS. 3 and 4, the sub-scanning direction transport unit 3 includes a transport roller 32 as a drive roller that changes a transport direction of the sheet 5 fed from the lower side by 90 degrees such that the sheet 5 is transported in a manner facing the image forming unit 2, a driven roller 33 as a tension roller, an endless transport belt 31 extending around the transport roller 32 and the driven roller 33, a charging roller 34 as a charger that charges the surface of the transport belt 31 with a high voltage, for example alternating current, from a high-voltage power supply, a guide member 35 that guides the transport belt 31 within an area opposing the image forming unit 2, pressure rollers 36 and 37 rotatably supported by a support member 136 and configured to press the sheet 5 against the transport belt 31 at a position opposing the transport roller 32, a guide plate 38 that presses the upper surface of the sheet 5 on which images are formed by the image forming unit 2, and a separation claw 39 that separates the sheet 5 on which images are formed from the transport belt 31. Furthermore, an inlet detection sensor 331 is disposed at an upstream side of the nip of the endless transport belt 31 and the pressure roller 36 with respect to the sheet transport direction so as to detect the sheet 5. Furthermore, an outlet detection sensor 332 is disposed at a downstream side of the claw 39 with respect to the sheet transport direction so as to detect the sheet 5.

The transport belt 31 is rotated to transport the sheet 5 in the sheet transport direction (sub-scanning direction) when the transport roller 32 is rotated through a timing belt 132 and a timing roller 133 (FIG. 2) by a sub-scanning motor 131 using a DC brushless motor.

A code wheel 137 of high resolution is attached to a shaft 32*a* of the transport roller 32. An encoder sensor 138 including a transmissive photosensor detects slits (not shown) formed in the code wheel 137. The code wheel 137 and the encoder sensor 138 form a rotary encoder.

Referring back to FIG. 1, the sheet feed unit 4 includes the sheet cassette 41 that is removable from the apparatus main body 1 and capable of stacking and storing a large number of sheets 5 therein, a sheet feed roller 42, a friction pad 43 for feeding the sheets 5 one by one, and a pair of registration rollers 44 for registration of the transported sheet 5.

The sheet feed unit 4 also includes a manual sheet feed tray 46 capable of stacking and storing a large number of sheets 5 therein, a manual sheet feed roller 47 that feeds the sheets 5 one by one from the manual sheet feed tray 46, a vertical transport roller 48 that transports the sheets 5 fed from another sheet feed cassette (not shown), which can be optionally attached to the lower side of the apparatus main body 1 and from a duplex print unit (not shown). Rollers for feeding the sheet 5 to the sub-scanning direction transport unit 3, such as the sheet feed roller 42, the pair of registration rollers 44, the manual sheet feed roller 47, and the vertical transport roller 48, are driven by a sheet feed motor 49, which for example is an HB stepping motor, via an electromagnetic clutch (not shown).

The sheet ejection/transport unit 7 includes three transport rollers 71*a*, 71*b*, and 71*c* (also referred to as transport rollers 71) that transport the sheet 5 separated by the separation claw 39 of the sub-scanning direction transport unit 3; three spurs 72*a*, 72*b*, and 72*c* (also referred to as spurs 72) facing transport rollers 71*a*, 71*b*, and 71*c*, respectively; a pair of reverse rollers 77 for reversing the sheet 5; and a pair of reverse/ejection rollers 78 for outputting the sheet 5 with its face down onto the sheet ejection tray 8. Furthermore, an ejection detection sensor 333 (FIG. 4) is disposed at a downstream side of the reverse/ejection rollers 78 with respect to the sheet transport direction.

As shown in FIG. 1, in the image forming apparatus, a single sheet manual feed tray 141 for manually feeding a single sheet is rotatably attached to one side of the apparatus main body 1. When manually feeding a single sheet, the single sheet manual feed tray 141 is rotated to an open position indicated by a double-dot chain line. The sheet 5 that has been manually fed from the single sheet manual feed tray 141 is guided by the upper surface of a guide plate 110 to be inserted straight between the transport roller 32 and the pressure roller 36 of the sub-scanning direction transport unit 3.

A straight ejection tray 181 to which a sheet 5 having an image formed thereon is ejected with its face up is rotatably attached to the other side of the apparatus main body 1. When the straight ejection tray 181 is rotated to an open position indicated by a double-dot chain line, the sheet 5 transported by the sheet ejection/transport unit 7 can be output straight to the straight ejection tray 181.

Figure 5:
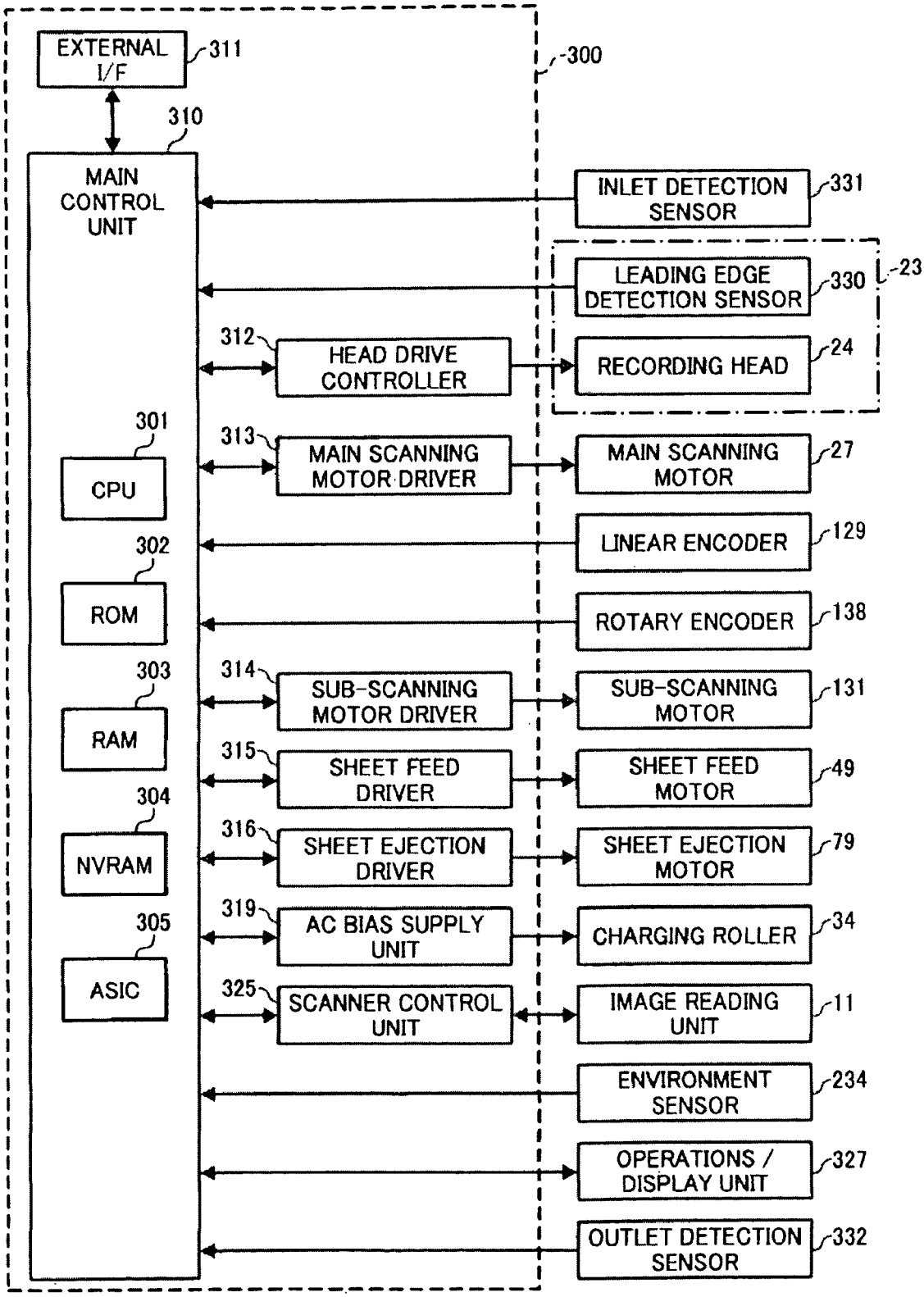
FIG. 5 is a block diagram illustrating a control unit of the image forming apparatus of FIG. 1.

The following describes an overview of a control unit 300 of the image forming apparatus with reference to FIG. 5.

The control unit 300 includes a main control unit 310 that controls the entire operation of the image forming apparatus and controls formation of an adjustment pattern, detection of an adjustment pattern, and adjustment of an impact position. The main control unit 310 includes a CPU 301, a ROM 302 that stores programs to be executed by the CPU 301 and other fixed data, a RAM 303 that temporarily stores image data, etc., a nonvolatile memory (NVRAM) 304 that retains data even when power is removed, and an ASIC 305 that processes input/output signals for processing images such as sorting and for controlling the apparatus.

The control unit 300 further includes an external I/F 311 through which signals and data are transmitted to a host device from the main control unit 310 and to the host device from the main control unit 310; a head drive controller 312 including a head driver (actually attached to the side of the recording heads 24) that controls and drives the recording heads 24 and includes an ASIC for head data generation sequence conversion; a main scanning motor driver 313 that drives the main scanning motor 27 for moving the carriage 23; a sub-scanning motor driver 314 that drives the sub-scanning motor 131; a sheet feed driver 315 that drives the sheet feed motor 49; a sheet ejection driver 316 that drives a sheet ejection motor 79 for driving each of rollers 71, 77, 78, etc., of the sheet ejection/transport unit 7; an AC bias supply unit 319 that supplies an AC bias to the charging roller 34; a maintenance recovery system driver (not shown) that drives a maintenance recovery motor (not shown) for driving the maintenance recovery mechanism 121; a duplexing unit driver (not shown) that drives a duplexing unit when the duplexing unit is attached; a solenoid driver (not shown) that drives various solenoids (SOLs); a clutch driver (not shown) that drives electromagnetic clutches (not shown); and a scanner control unit 325 that controls the image reading unit 11.

The main control unit 310 receives various detection signals, such as signals from the leading edge detection sensor 330 disposed on the carriage 23, signals from the inlet detection sensor 331, and signals indicating the temperature and humidity (environmental conditions) around the transport belt 31 from an environment sensor 234. The main control unit 310 receives detection signals from various other sensors (not shown). The main control unit 310 receives instructions entered through various keys, such as numeric keys and a print start key, disposed on the apparatus main body 1. The main control unit 310 also receives instructions entered through an operations/display unit 327 and outputs information to be displayed to the operations/display unit 327.

The main control unit 310 also receives an output signal from the photosensor of the linear encoder 129 for detecting the position of the carriage 23, and controls the main scanning motor 27 through the main scanning motor driver 313 according to the output signal so as to reciprocate the carriage 23 in the main-scanning direction. The main control unit 310 also receives an output signal (pulse) from the photosensor of the rotary encoder 138 for detecting the amount of the rotation of the transport belt 31, and controls the sub-scanning motor 131 through the sub-scanning motor driver 314 according to the output signal so as to rotate the transport belt 31 via the transport roller 32.

An image forming operation by the image forming apparatus having the above-described configuration is described below. The amount of rotation of the transport roller 32, which drives the transport belt 31, is detected. According to the detected amount of rotation, the sub-scanning motor 131 is controlled. The AC bias supply unit 319 applies a bipolar rectangular-wave high voltage as an alternating voltage to the charging roller 34. Thus, the transport belt 31 is alternately positively and negatively charged at predetermined widths in the transport direction of the transport belt 31, thereby forming a non-uniform electric field on the transport belt 31.

When the sheet 5 sent from the sheet feed unit 4 passes through between the transport roller 32 and the first pressure roller 36 onto the transport belt 31 on which the non-uniform electric field is generated by positive and negative charges, the sheet 5 is instantaneously polarized along a direction of the electric field and is adhered onto the transport belt 31 due to an electrostatic attraction force. Thus, the sheet 5 is transported along with the movement of the transport belt 31.

The sheet 5 is intermittently transported by the transport belt 31. The carriage 23 is moved in the main-scanning direction so as to record or print images on the sheet 5 when it is not moving by ejecting droplets of recording liquids (e.g., ink) from the recording heads 24. The separation claw 39 separates the leading edge of the printed sheet 5 from the transport belt 31 to transport the sheet 5 to the sheet ejection/transport unit 7, by which the sheet 5 is ejected to the sheet ejection tray 8.

The carriage 23 is moved to the side of the maintenance recovery mechanism 121 while standing by for a print or recording operation. The nozzle faces of the recording heads 24 are capped by the caps 122 for keeping the nozzles wet, thereby preventing poor ejection due to ink dryout. A recovery operation is performed for ejecting thickened recording liquid and bubbles by suctioning the recording liquid from the nozzles of the recording heads 24 capped by the suction cap 122*a* and the dry-proof caps 122*b*-122*e*. The wiper blade 124 wipes the nozzle faces of the recording heads 24 to remove ink adhering to the nozzle faces. Further, before starting a recording operation or during a recording operation, idle ejection is performed for ejecting ink to the idle ejection receiver 125 and not for forming images. The idle ejection enables the recording heads 24 to maintain stable ejection performance.

Figure 6:
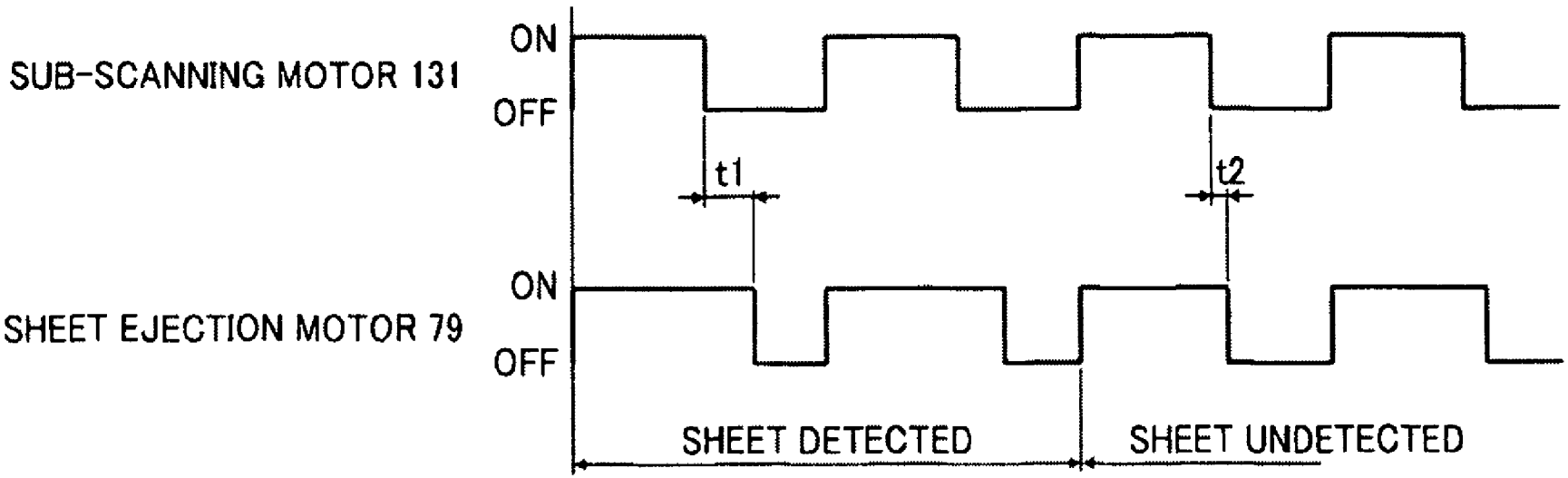
FIG. 6 is a timing diagram for explaining a driving control of a sub-scanning motor and a sheet ejection motor.

The following describes an intermittently transporting operation of the sheet in the image forming apparatus with reference to FIG. 6. FIG. 6 illustrates a driving timing of the sub-scanning motor 131 and the sheet ejection motor 79.

In the image forming apparatus, the sheet 5 is intermittently transported by intermittently driving of the sub-scanning motor 131 as shown in FIG. 6, and an image is formed by ejecting liquid droplets from the recording heads 24. Then, the sheet 5 separated by the separation claw 39 from the transport belt 31 is transported to the sheet ejection/transport unit 7. As shown in FIG. 6, the sheet ejection motor 79 of the sheet ejection/transport unit 7 is also driven intermittently in synchronization with the sub-scanning motor 131 and transports the sheet 5 intermittently for ejection.

The stop timing of one driving time (turn-on time) of the sheet ejection motor 79 is delayed for a time "t", a delay time, relative to the stop timing of one driving time (turn-on time) of the sub-scanning motor 131. In other words, the stop timing of the sheet transportation by the sheet ejection/transport unit 7 (at which the sheet ejecting motor 24 is turned off to stop driving) is delayed for time "t" as a delay time relative to the stop timing of the sheet transportation by the transport belt 31 (at which the sub-scanning motor 131 is turned off to stop driving). Thus, the sheet 5 is intermittently transported by the transport belt 31 of the sub-scanning direction transport unit 3 in a state of tensioning by the sheet ejection/transport unit 7 since the ejection/transport 7 stops transporting the sheet 5 with a delay from when the transport belt 31 stops transporting the sheet 5, to thereby maintain a tension on the sheet 5. This makes it possible to maintain the flatness of the sheet 5 and prevent a deflection of the sheet 5 between the sub-scanning direction transport unit 3 and the sheet ejection/transport unit 7.

In this embodiment, while the inlet detection sensor 331 detects the sheet 5, the delay time "t" is set as time "t1". When the inlet detection sensor 331 no longer or does not detect the sheet 5 (i.e., the sheet is undetected), the delay time "t" is set as time "t2", which is shorter than "t1" ($t2<t1$).

More specifically, while the inlet detection sensor 331 detects the sheet 5, the sheet 5 is held on the transport belt 31 by the electrostatic attraction force and is also nipped by the transport belt 31 and the pressure roller 36. Therefore, the sheet 5 is transported in the state of being tensioned by the sheet ejection/transport unit 7 as described above, and the sheet 5 does not slip on the transport belt 31.

On the other hand, when the inlet detection sensor 331 does not detect the sheet 5, the sheet 5 has passed the nip of the transport belt 31 and the pressure roller 36. Therefore, the sheet 5 is held on the transport belt 31 by only the electrostatic attraction force. When the sheet 5 is held on the transport belt 31 by only the electrostatic attraction force, if the tension of the sheet 5 by the sheet ejection/transport unit 7 is stronger than the electrostatic attraction force of the transport belt 31, a displacement of the sheet 5 may occur on the transport belt 31, resulting in a potential problem in forming the image.

To address that potential problem, the present invention includes an operation to decrease tension on the sheet after it passes the nip between the transport belt 31 and pressure roller 36. That is, the tension of the sheet 5 by the sheet ejection/transport unit 7 is decreased by setting the delay time "t", which is the delay time of the driving stop timing of the sheet ejection/transport unit 7 relative to the driving stop timing of the transport belt 31, as "t2" that is shorter than "t1". This makes it possible to prevent a displacement of the sheet 5 on the transport belt 31 and a problem in forming the image, even if the sheet 5 is held on the transport belt 31 by only the electrostatic attraction force.

When the environmental conditions are low-temperature and low-humidity or the type of the sheet 5 is a sheet for an overhead projector or a thick paper, the electrostatic attraction force of the transport belt 31 tends to decrease in comparison with other conditions or other sheets. Consequently, especially when the environmental conditions are low-temperature and low-humidity or the type of the sheet 5 is a sheet for an overhead projector or a thick paper, it is possible to prevent the risk of problems in forming the image by also setting the delay time of the sheet ejection/transport unit 7 "t" as "t2" that is shorter than "t1" without decelerating recording speed.

Figure 7:
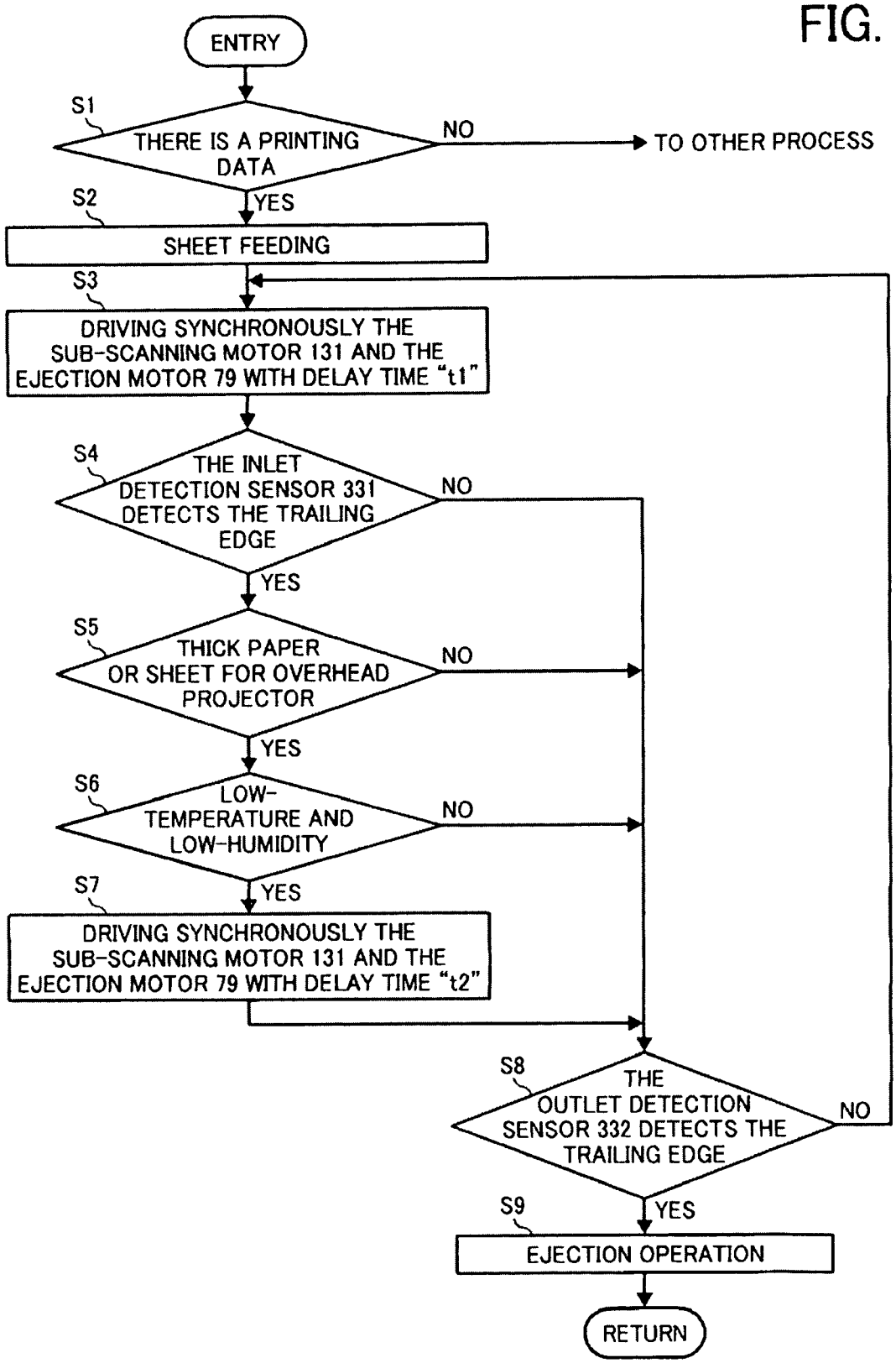
FIG. 7 is a flow diagram for explaining an example of a control of sub-scanning and ejection/transport in the image forming apparatus of FIG. 1.

The following describes an example of a driving control for the sub-scanning motor 131 and the sheet ejection motor 79 by the control unit 300 in the operation described above with reference to FIG. 7.

When entering a state that there is printing data to be printed on a sheet 5, (Yes in S1), the sheet 5 is fed from the sheet feed unit 4 or the manual sheet feed tray 46 or the single sheet manual feed tray 141 (S2). The sub-scanning motor 131 and the sheet ejection motor 79 start intermittent drive at a required timing (S3). The delay time "t", which is the delay time of the driving stop timing of the sheet ejection motor 79 relative to the driving stop timing of the sub-scanning motor 131, is set as "t1", because the inlet detection sensor 331 detects the sheet 5. The sheet ejection motor 79 is driven in synchronization with the sub-scanning motor 131 with the delay time "t1".

Then, it is determined whether the inlet detection sensor 331 no longer detects the sheet 5 or not (S4). When the inlet detection sensor 331 no longer detects the sheet 5 (Yes in S4), it is determined whether the type of the sheet 5 is a predetermined type of sheet (in this example, a thick paper thicker than a predetermined thickness or a sheet for overhead projector) or not (S5). When the type of the sheet 5 is the predetermined type of sheet (Yes in S5), it is determined whether the environmental conditions are low-temperature and low-humidity (lower than a predetermined temperature and humidity) or not (S6). When the sheet 5 is a thick paper or a sheet for overhead projector and the environmental conditions are low-temperature and low-humidity (Yes in S6), the delay time "t", which is the delay time of the driving stop timing of the sheet ejection motor 79 relative to the driving stop timing of the sub-scanning motor 131, is changed to "t2" (S7). The sheet ejection motor 79 is then driven in synchronization with the sub-scanning motor 131 with the delay time "t2".

After that, when the outlet detection sensor 332 detects a trailing edge of the sheet 5 (Yes in S8) (i.e., the sheet 5 is separated from the transport belt 31), the sheet 5 is ejected and transported to a required ejection portion from the sheet ejection/transport unit 7 (S8).

As described above, while the inlet detection sensor 331 detects the sheet 5, the stop timing of the sheet transportation by the ejection/transport unit 7 is delayed by the predetermined delay time relative to the stop timing of the sheet transportation by the transport belt 31. And after the inlet detection sensor 331 detects the trailing edge of the sheet 5, the delay time is controlled to shorten. Therefore, when the sheet holding force onto the transport belt 31 becomes only the attraction force of the transport belt 31 after the sheet 5 has passed the nip of the pressure roller 36 and the transport belt 31, it is possible to decrease a tension by the sheet ejection/transport unit 7. This makes it possible to maintain a sheet transport accuracy and to prevent a debasement of image quality.

The type of the sheet 5 is able to be input from the operations/display unit 327. Alternatively, the type of sheet may be determined by detecting the sheet while transportation. Furthermore, a surface resistance of the sheet 5, a volume resistance of the sheet 5, thickness of the sheet 5, etc. can be detected as a substitute for the type. Alternatively, it is also able to receive the information from a host information-processing device.

Figure 8:
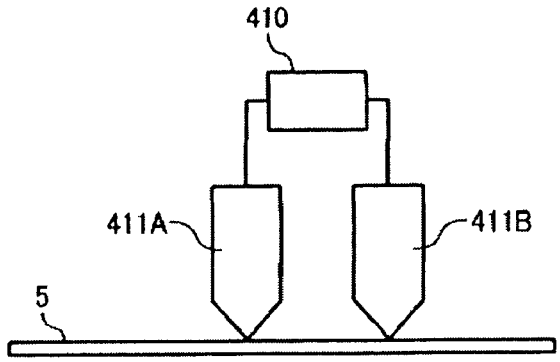
FIG. 8 is a schematic diagram for explaining a device for detecting the surface resistance of the sheet.

As shown as an example in FIG. 8, a device for detecting the surface resistance of a sheet 5 includes electrodes 411A, 411B that contact the sheet 5, and a resistance measurement device 410 that measures a resistance between the electrodes 411A and 411B.

Figure 9:
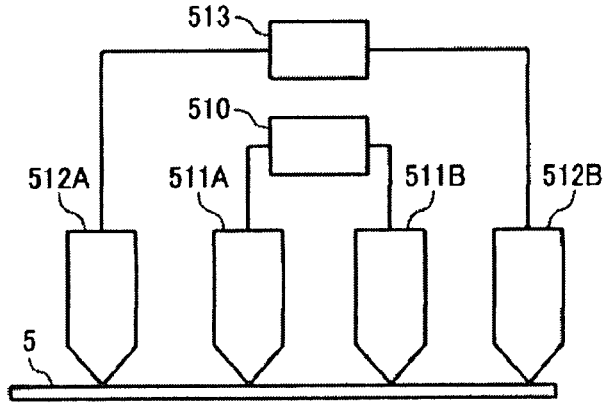
FIG. 9 is a schematic diagram for explaining a device for detecting the volume resistance of the sheet.

As shown as an example in FIG. 9, a device for detecting the volume resistance of the sheet includes electrodes 511A, 511B that contact the sheet 5, a voltage measurement device 510 that measures a voltage between the electrodes 511A and 511B, electrodes 512A, 512B that contact the sheet 5, and a constant-current power supply 513 that applies a predetermined constant-current between the electrodes 512A and 512B.

Figure 10:
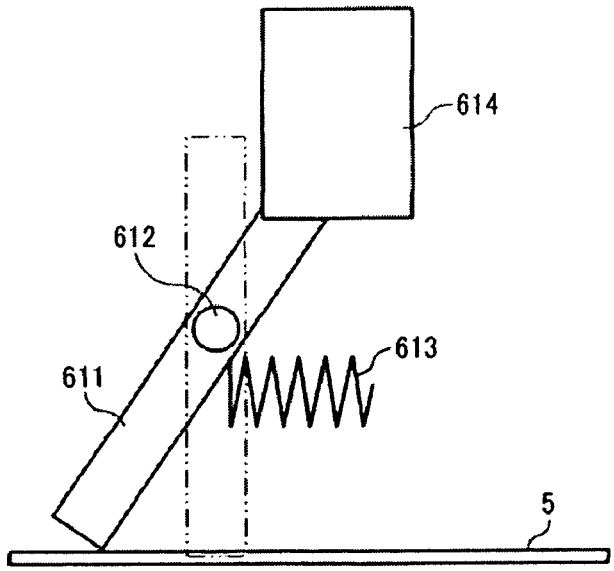
FIG. 10 is a schematic diagram for explaining a device for detecting the thickness of the sheet.
Figure 11A:
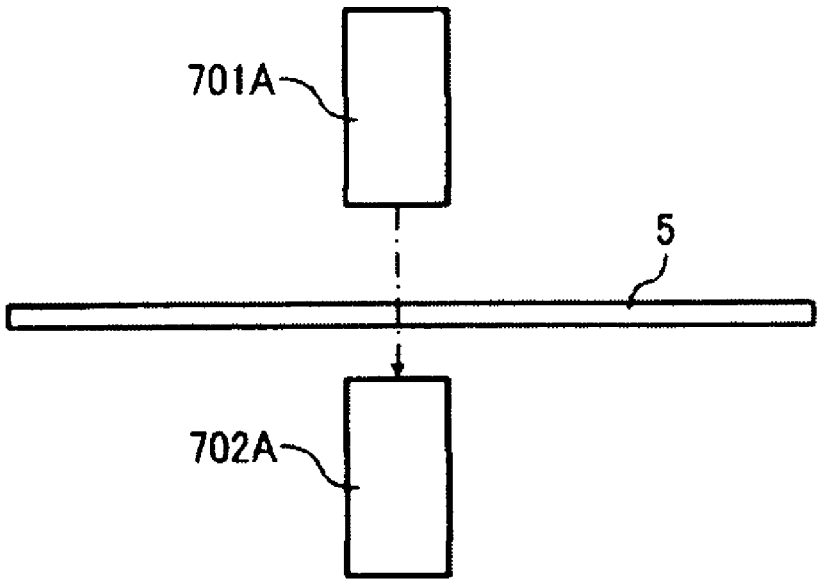
FIGS. 11A and 11B are schematic diagrams for explaining other examples of a device for detecting the thickness of the sheet.
Figure 11B:
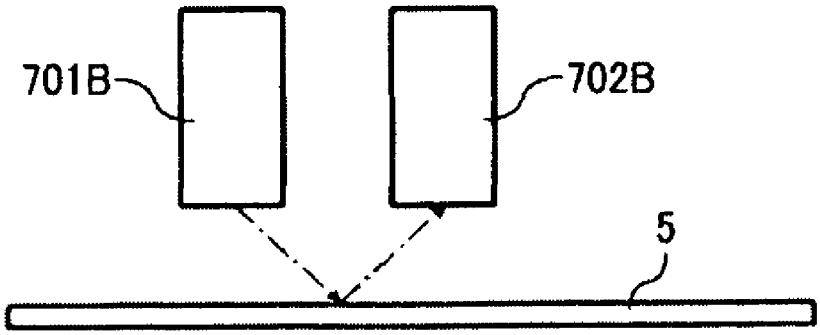

As shown as an example in FIG. 10, a device for detecting the thickness of the sheet includes an arm 611 that is held swingably by an arm shaft 612, an elastic member 613 that biases the arm 611 toward the sheet 5, and a detection member 614 that detects a swing amount of the arm 611. Alternatively, as shown in FIG. 11A, a thickness detector can include a transmissive photosensor that includes a light-emitting portion 701A and a light-receiving portion 702A. The light-emitting portion 701A is opposite to the light-receiving portion 702A across the sheet 5. Furthermore, as shown in FIG. 11B, a thickness detector can include a reflective photosensor that includes a light-emitting portion 701B and a light-receiving portion 702B. The light-emitting portion 701B and the light-receiving portion 702B are opposite to the sheet 5.

In the above mentioned example, an electrostatic transport belt is used as a transport belt. However, it is possible to apply a transport belt that adheres a sheet by applying vacuuming with air.

Furthermore, it is also possible to apply this invention to an image forming apparatus that adheres a sheet by vacuuming with air at a position opposing a recording head and transports the adhered sheet by a roller that is disposed at an upstream side of the recording head with respect to the sheet transport direction.

Also in this case, the image forming apparatus is configured to include a transport device that adheres the sheet and transports the sheet intermittently opposing the recording head and includes a roller that nips the sheet, a sheet detection device that detects the sheet at the upstream side of the transport device with respect to the sheet transport direction, and an ejection/transport device that is disposed at the downstream side of the sheet detection device with respect to the sheet transport direction and transports the sheet to sheet ejection direction by driving intermittently in synchronization with the transport device. While the sheet detection device detects the sheet, the stop timing of the sheet transportation by the ejection/transport device is delayed the predetermined delay time relative to the stop timing of the sheet transportation by the transport device. And after the sheet detection device detects the trailing edge of the sheet, the delay time is controlled to shorten. This makes it possible to maintain a sheet transport accuracy and to prevent a debasement of image quality.

Numerous additional modifications and variations are possible in light of the above teachings. It is therefore to be understood that within the scope of the appended claims, the disclosure of the present invention may be practiced otherwise than as specifically described herein.

The invention claimed is:

1. An image forming apparatus comprising:

a recording head that ejects liquid droplets onto a sheet;

a transport belt opposing the recording head that intermittently transports the sheet in a sheet transport direction;

a pressure device that presses the sheet against the transport belt at an upstream side of the recording head with respect to the sheet transport direction;

a sheet detection device that detects the sheet at an upstream side of a nip between the pressure device and the transport belt with respect to the sheet transport direction;

an ejection/transport device disposed at a downstream side of the sheet detection device with respect to the sheet transport direction, and that transports the sheet in a sheet ejection direction by driving intermittently in synchronization with the transport belt; and a control device that controls generating a first stop timing of the sheet transportation by the transport belt, at which first stop timing the transfer belt stops transporting the sheet, and that controls a predetermined delay time after which a second stop timing is generated, at which second stop timing the ejection/transport device stops transporting the sheet, and wherein the control device sets the predetermined delay time to be a first value when the sheet detection device detects the sheet, and sets the predetermined delay time to be a second value when the sheet detector device does not detect the sheet, and the second value is less than the first value.

2. The image forming apparatus according to claim 1, wherein the control device shortens the delay time only when a detected temperature is lower than a predetermined amount and a detected humidity is lower than a predetermined amount.

3. The image forming apparatus according to claim 1, wherein the control device shortens the delay time only when the type of the sheet is a predetermined type.

4. The image forming apparatus according to claim 2, wherein the control device shortens the delay time only when the type of the sheet is a predetermined type.

5. The image forming apparatus according to claim 3, wherein the predetermined type of sheet is a sheet thicker than a predetermined thickness or a sheet for an overhead projector.

6. The image forming apparatus according to claim 4, wherein the predetermined type of sheet is a sheet thicker than a predetermined thickness or a sheet for an overhead projector.

7. An image forming apparatus comprising:

a recording head that ejects liquid droplets onto a sheet;

a transport device opposing the recording head that intermittently transports the sheet in a sheet transport direction and that includes a roller that nips the sheet;

a pressure device that presses the sheet against the transport device at an upstream side of the roller with respect to the sheet transport direction;

a sheet detection device that detects the sheet at an upstream side of the transport device with respect to the sheet transport direction;

an ejection/transport device disposed at a downstream side of the sheet detection device with respect to the sheet transport direction, and that transports the sheet in a sheet ejection direction by driving intermittently in synchronization with the transport device; and a control device that controls generating a first stop timing of the sheet transportation by the transport belt, at which first stop timing the transfer belt stops transporting the sheet, and that controls a predetermined delay time after which a second stop timing is generated, at which second stop timing the ejection/transport device stops transporting the sheet, and wherein the control device sets the predetermined delay time to be a first value when the sheet detection device detects the sheet, and sets the predetermined delay time to be a second value when the sheet detector device does not detect the sheet, and the second value is less than the first value.

8. The image forming apparatus according to claim 7, wherein the control device shortens the delay time only when a detected temperature is lower than a predetermined amount and a detected humidity is lower than a predetermined amount.

9. The image forming apparatus according to claim 7, wherein the control device shortens the delay time only when the type of the sheet is a predetermined type.

10. The image forming apparatus according to claim 7, wherein the control device shortens the delay time only when the type of the sheet is a predetermined type.

11. The image forming apparatus according to claim 9, wherein the predetermined type of sheet is a sheet thicker than a predetermined thickness or a sheet for an overhead projector.

12. The image forming apparatus according to claim 10, wherein the predetermined type of sheet is a sheet thicker than a predetermined thickness or a sheet for an overhead projector.

13. An image forming method for an image forming apparatus including a recording head that ejects liquid droplets onto a sheet, a transport device opposing the recording head that intermittently transports the sheet in a sheet transport direction, a pressure device that presses the sheet against the transport belt at an upstream side of the recording head with respect to the sheet transport direction, and an ejection/transport device disposed at a downstream side of the sheet detection device with respect to the sheet transport direction, and that transports the sheet in a sheet ejection direction by driving intermittently in synchronization with the transport belt, the method comprising:

detecting the sheet at an upstream side of a nip between the pressure device and the transport belt with respect to the sheet transport direction;

controlling generating a first stop timing of the sheet transportation by the transport belt, at which first stop timing the transfer belt stops transporting the sheet, and controlling a predetermined delay time after which a second stop timing is generated, at which second stop timing the ejection/transport device stops transporting the sheet, and wherein the controlling sets the predetermined delay time to be a first value when the sheet detection device detects the sheet, and sets the predetermined delay time to be a second value when the sheet detector device does not detect the sheet, and the second value is less than the first value.

14. The image forming method according to claim 13, wherein the transport device includes a transport belt.

15. The image forming method according to claim 13, wherein the controlling shortens the delay time only when a detected temperature is lower than a predetermined amount and a detected humidity is lower than a predetermined amount.

16. The image forming method according to claim 13, wherein the controlling shortens the delay time only when the type of the sheet is a predetermined type.

17. The image forming method according to claim 15, wherein the controlling shortens the delay time only when the type of the sheet is a predetermined type.

18. The image forming apparatus according to claim 16, wherein the predetermined type of sheet is a sheet thicker than a predetermined thickness or a sheet for an overhead projector.

19. The image forming apparatus according to claim 17, wherein the predetermined type of sheet is a sheet thicker than a predetermined thickness or a sheet for an overhead projector.

* * * * *